US005978764A

United States Patent [19]

Lowry et al.

[11] Patent Number: 5,978,764

[45] Date of Patent: Nov. 2, 1999

[54] SPEECH SYNTHESIS

[75] Inventors: Andrew Lowry; Peter Jackson; Andrew Paul Breen, all of Ipswich, United Kingdom

[73] Assignee: British Telecommunications public limited company, London, United Kingdom

[21] Appl. No.: 08/700,369

[22] PCT Filed: Mar. 7, 1996

[86] PCT No.: PCT/GB96/00529

§ 371 Date: Aug. 26, 1996

§ 102(e) Date: Aug. 26, 1996

[87] PCT Pub. No.: WO96/27870

PCT Pub. Date: Sep. 12, 1996

[30] Foreign Application Priority Data

Mar. 7, 1995 [EP] European Pat. Off. ..... 95301478

[51] Int. Cl.[6] ..... G10B 9/06

[52] U.S. Cl. ..... 704/258; 704/224; 704/208

[58] Field of Search ..... 704/258, 224, 704/208, 214, 265, 248; 385/12, 14

[56] References Cited

U.S. PATENT DOCUMENTS 5,091,948 2/1992 Kametani ..... 381/42
5,384,893 1/1995 Hutchins ..... 704/258
5,469,257 11/1995 Blake ..... 385/12

FOREIGN PATENT DOCUMENTS 0 107 945 5/1984 European Pat. Off. .
0 427 485 A2 11/1990 European Pat. Off. .
0 427 485 A3 5/1991 European Pat. Off. .
PCT/96/00529 7/1996 United Kingdom .

OTHER PUBLICATIONS

Shadle et al. Speech Synthesis by Linear Interpolation of Spectral Parameters Between Dyad Boundaries', Nov. 1979.

*Primary Examiner*—David R. Hudspeth
*Assistant Examiner*—Daniel Abebe
*Attorney, Agent, or Firm*—Nixon & Vanderhye P.C.

[57] ABSTRACT

Portions of recorded speech waveform (e.g., corresponding to phonemes) are combined to synthesize words. In order to provide a smoother delivery, each voiced portion of a waveform portion has its amplitude adjusted to a predetermined reference level. The scaling factor used is varied gradually over a transition region between such portions and between voiced and unvoiced portions.

8 Claims, 3 Drawing Sheets

SPEECH SYNTHESIS

BACKGROUND OF THE INVENTION

1. Field of the Invention

This invention relates generally to the synthesis of speech waveforms having a smoothed delivery.

2. Related Art

One method of synthesising speech involves the concatenation of small units of speech in the time domain. Thus representations of speech waveform may be stored, and small units such as phonemes, diphones or triphones—i.e. units of less than a word—selected according to the speech that is to be synthesised, and concatenated. Following concatenation, known techniques may be employed to adjust the composite waveform to ensure continuity of pitch and signal phase. However, another factor affecting the perceived quality of the resulting synthesised speech is the amplitude of the units; preprocessing of the waveforms—i.e. adjustment of amplitude prior to storage—is not found to solve this problem, inter alia because the length of the units extracted from the stored data may vary.

SUMMARY OF THE INVENTION

According to the present invention there is provided a speech synthesiser comprising a store containing representations of speech waveform;

selection means responsive in operation to phonetic representations input thereto of desired sounds to select from the store units of speech waveform representing portions of words corresponding to the desired sounds;

means for concatenating the selected units of speech waveform characterised by means for adjusting the amplitude of at least the voiced portion relative to a predetermined reference level.

BRIEF DESCRIPTION OF THE DRAWINGS

One example of the invention will now be described, by way of example, with reference to the accompanying drawings, in which.

DETAILED DESCRIPTION OF EXEMPLARY EMBODIMENTS

Figure 1:
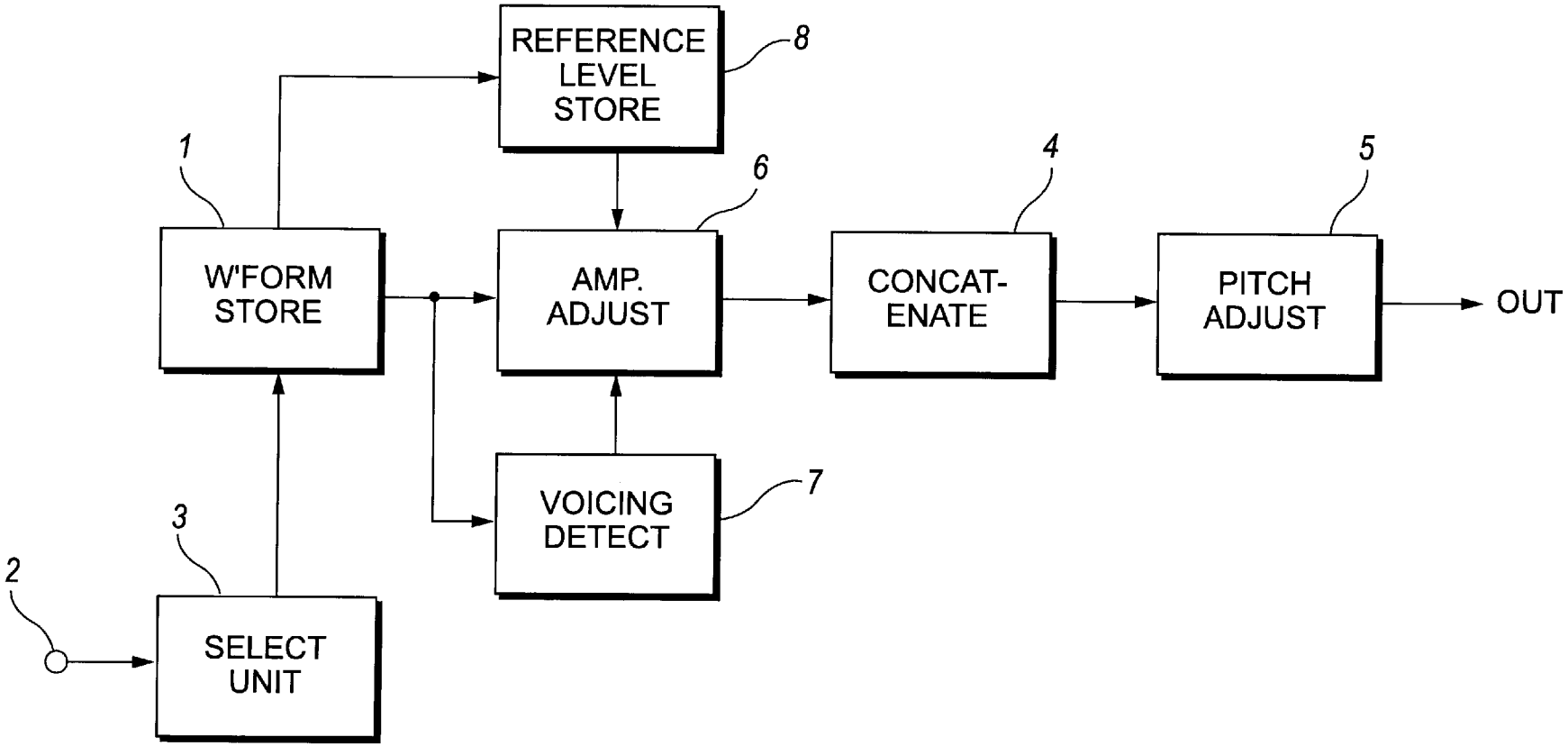
FIG. 1 is a block diagram of one example of speech synthesis according to the invention.

In the speech synthesiser of FIG. 1, a store 1 contains speech waveform sections generated from a digitised passage of speech, originally recorded by a human speaker reading a passage (of perhaps 200 sentences) selected to contain all possible (or at least, a wide selection of) different sounds. Accompanying each section is stored data defining "pitchmarks" indicative of points of glottal closure in the signal, generated in conventional manner during the original recording.

An input signal representing speech to be synthesised, in the form of a phonetic representation is supplied to an input 2. This input may if wished be generated from a text input by conventional means (not shown). This input is processed in known manner by a selection unit 3 which determines, for each unit of the input, the addresses in the store 1 of a stored waveform section corresponding to the sound represented by the unit. The unit may, as mentioned above, be a phoneme, diphone, triphone or other sub-word unit, and in general the length of a unit may vary according to the availability in the waveform store of a corresponding waveform section.

The units, once read out, are concatenated at 4 and the concatenated waveform subjected to any desired pitch adjustments at 5.

Prior to this concatenation, each unit is individually subjected to an amplitude normalisation process in an amplitude adjustment unit 6 whose operation will now be described in more detail. The basic objective is to normalise each voiced portion of the unit to a fixed RMS level before any further processing is applied. A label representing the unit selected allows the reference level store 8 to determine the appropriate RMS level to be used in the normalisation process. Unvoiced portions are not adjusted, but the transitions between voiced and unvoiced portions may be smoothed to avoid sharp discontinuities. The motivation for this approach lies in the operation of the unit selection and concatenation procedures. The units selected are variable in length, and in the context from which they are taken. This makes preprocessing difficult, as the length, context and voicing characteristics of adjoining units affect the merging algorithm, and hence the variation of amplitude across the join. This information is only known at run-time as each unit is selected. Postprocessing after the merge is equally difficult.

The first task of the amplitude adjustment unit is to identify the voiced portions(s) (if any) of the unit. This is done with the aid of a voicing detector 7 which makes use of the pitch timing marks indicative of points of glottal closure in the signal, the distance between successive marks determining the fundamental frequency of the signal. The data (from the waveform store 1) representing the timing of the pitch marks are received by the voicing detector 7 which, by reference to a maximum separation corresponding to the lowest expected fundamental frequency, identifies voiced portions of the unit by deeming a succession of pitch marks separated by less than this maximum to constitute a voiced portion. A voiced portion whose first (or last) pitchmark is within this maximum of the beginning (or end) of the speech unit is, respectively, considered to begin at the beginning of the unit or end at the end of the unit. This identification step is shown as step 10 in the flowchart shown in FIG. 2.

Figure 2:
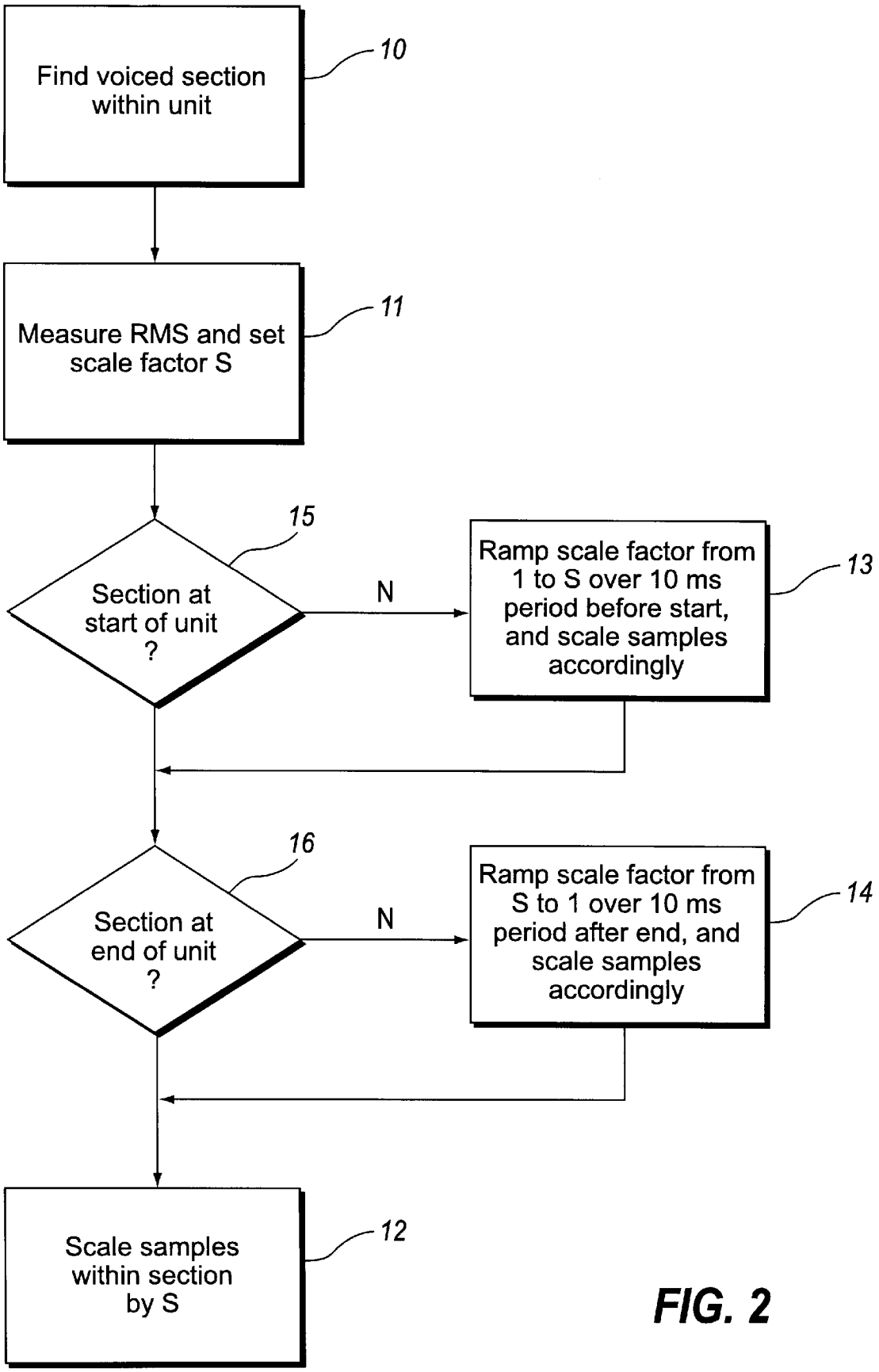
FIG. 2 is a flow chart illustrating operation of the synthesis.
Figure 3:
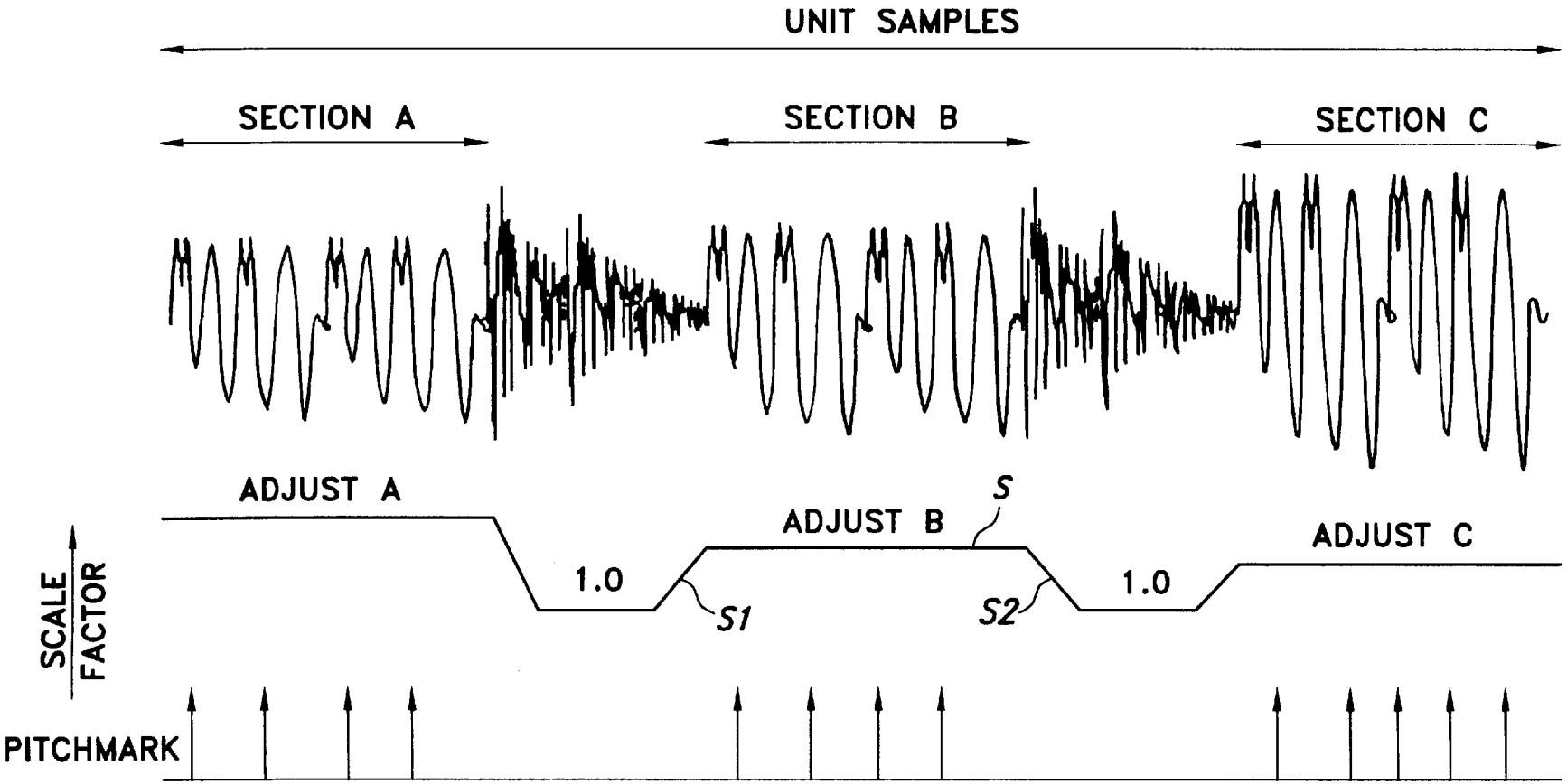
FIG. 3 is a timing diagram.

The amplitude adjustment unit 6 then computes (step 11) the RMS value of the waveform over the voiced portion, for example the portion B shown in the timing diagram of FIG. 3, and a scale factor S equal to a fixed reference value divided by this RMS value. The fixed reference value may be the same for all speech portions, or more than one reference value may be used specific to particular subsets of speech portions. For example, different phonemes may be allocated different reference values. If the voiced portion occurs across the boundary between two different subsets, then the scale factor S can be calculated as a weighted sum of each fixed reference value divided by the RMS value. Appropriate weights are calculated according to the proportion of the voiced portion which falls within each subset. All sample values within the voiced portion are (step 12 of FIG. 2) multiplied by the scale factor S. In order to smooth voiced/unvoiced transitions, the last 10 ms of unvoiced speech samples prior to the voiced portion are multiplied (step 13) by a factor $S_1$ which varies linearly from 1 to S over this period. Similarly, the first 10 ms of unvoiced speech samples following the voiced portion are multiplied (step 14) by a factor $S_2$ which varies linearly from S to 1. Tests 15, 16 in the flowchart ensure that these steps are not performed when the voiced portion respectively starts or ends at the unit boundary.

FIG. 3 shows the scaling procedure for a unit with three voiced portions A, B, C, separated by unvoiced portions. Portion A is at the start of the unit, so it has no ramp-in segment, but has a ramp-out segment. Portion B begins and ends within the unit, so it has a ramp-in and ramp-out segment. Portion C starts within the unit, but continues to the end of the unit, so it has a ramp-in, but no ramp-out segment.

This scaling process is understood to be applied to each voiced portion in turn, if more than one is found.

Although the amplitude adjustment unit may be realised in dedicated hardware, preferably it is formed by a stored program controlled processor operating in accordance with the flowchart of FIG. 2.

What is claimed is:

1. A speech synthesiser comprising:

a store containing representations of speech waveform;

selection means responsive in operation to phonetic representations input thereto of desired sounds to select from the store units of speech waveform representing portions of words corresponding to the desired sounds;

voiced portion identification means arranged in operation to identify voiced portions of the selected units;

means for concatenating the selected units of speech waveform; and amplitude adjustment means responsive to said voiced portion identification means and arranged to adjust the amplitude of the voiced portions of the units relative to a predetermined reference level and to leave unchanged at least part of any unvoiced portion of the unit.

2. A speech synthesiser as in claim 1 in which the adjustment means is arranged to scale each voiced portion by a respective scaling factor, and to scale the adjacent part of any abutting unvoiced portion by a factor which varies monotonically over the duration of that part between the scaling factor and unity.

3. A speech synthesiser as in claim 1 or 2 in which a plurality of reference levels is used, the adjustment means being arranged for each voiced portion, to select a reference level in dependent upon the sound represented by that portion.

4. A speech synthesiser as in claim 3 in which each phoneme is assigned a reference level and any voiced portion containing waveform segments from more than one phoneme is assigned a reference level which is a weighted sum of the levels assigned to the phonemes contained therein, weighted according to the relative duration of the segments.

5. A method for synthesising speech comprising:

storing representations of speech waveform;

selecting, in response to phonetic representations of desired sounds, units of stored speech waveform representing portions of words corresponding to the desired sounds;

identifying voiced portions of the selected units;

concatenating the selected units of speech waveform; and adjusting the amplitude of the voiced portions of the units relative to a predetermined reference level and responsive to said voiced portion while leaving unchanged at least part of any unvoiced portion of the unit.

6. A method as in claim 5 in which the adjusting step scales each voiced portion by a respective scaling factor, and scales the adjacent part of any abutting unvoiced portion by a factor which varies monotonically over the duration of that part between the scaling factor and unity.

7. A method as in claim 5 or 6 in which a plurality of reference levels is used, the adjusting step selecting a reference level for each voiced portion dependent upon the sound represented by that portion.

8. A method as in claim 7 in which each phoneme is assigned a reference level and any voiced portion containing waveform segments from more than one phoneme is assigned a reference level which is a weighted sum of the levels assigned to the phonemes contained therein, weighted according to the relative duration of the segments.

* * * * *